United States Patent [19]

Morgan

[11] Patent Number: 4,598,908

[45] Date of Patent: Jul. 8, 1986

[54] WEIGHT LIFTING GYM

[76] Inventor: Harold W. Morgan, Box 234, R.D. #1, Port Matilda, Pa. 16870

[21] Appl. No.: 580,652

[22] Filed: Feb. 16, 1984

[51] Int. Cl.[4] ..... A63B 21/00

[52] U.S. Cl. ..... 272/134; 272/117; 272/143; 272/123

[58] Field of Search ..... 272/123, 117, 144, 136, 272/142, 140, 93

[56] References Cited

U.S. PATENT DOCUMENTS

| | | | |
|---|---|---|---|
| 1,416,741 | 5/1922 | Nicholls | 272/140 X |
| 3,033,198 | 5/1962 | Jensen | 272/117 X |
| 3,785,644 | 1/1974 | Bradley et al. | 272/140 |
| 4,256,301 | 3/1981 | Goyette | 272/123 |
| 4,257,590 | 3/1981 | Sullivan et al. | 272/123 X |
| 4,509,746 | 4/1985 | Mask | 272/144 |

FOREIGN PATENT DOCUMENTS

| | | | |
|---|---|---|---|
| 263306 | 4/1949 | Switzerland | 272/140 |

*Primary Examiner*—Richard J. Apley
*Assistant Examiner*—William R. Browne
*Attorney, Agent, or Firm*—Thomas E. Sterling

[57] ABSTRACT

A multi-purpose weight lifting gym having a barbell with retractable cables activated by a recoil spring and a hold/release lever whereby a liftable weight is attached to the cable when the barbell is at the desired position. The gym further has pulley and roller assemblies engagable by the cable which allow the barbell and/or hand held devices to be manipulated in a variety of directions. The device also embodies a fold-down backrest permitting standing, sitting, or lying exercises to be done within the confines of the gym.

9 Claims, 17 Drawing Figures

Fig. 4.
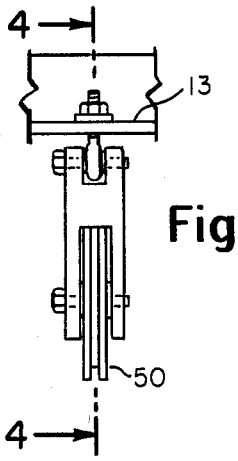
Fig. 3.
Fig. 5.
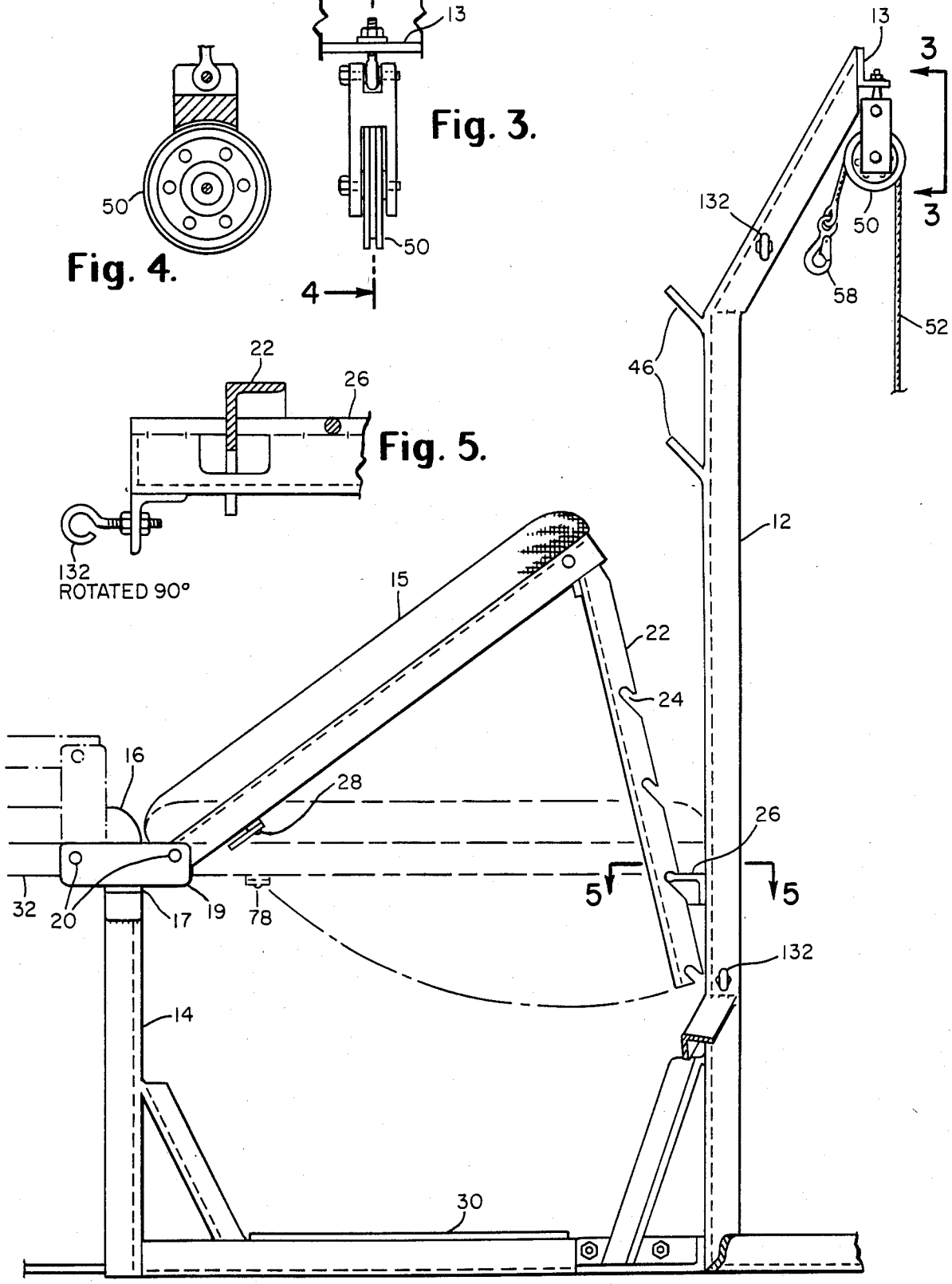
Fig. 2.

Fig. 6.
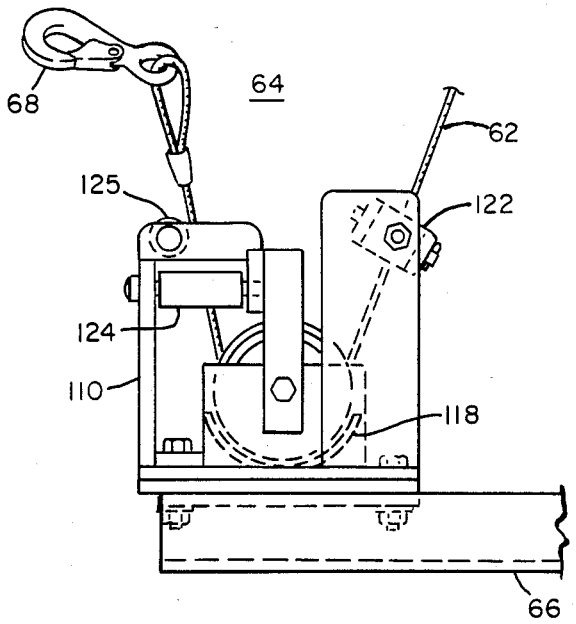
Fig. 7.
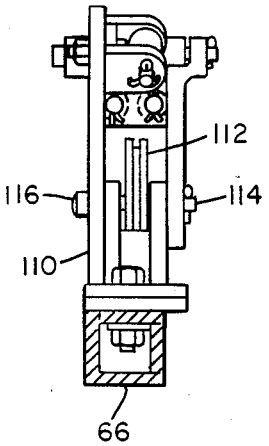
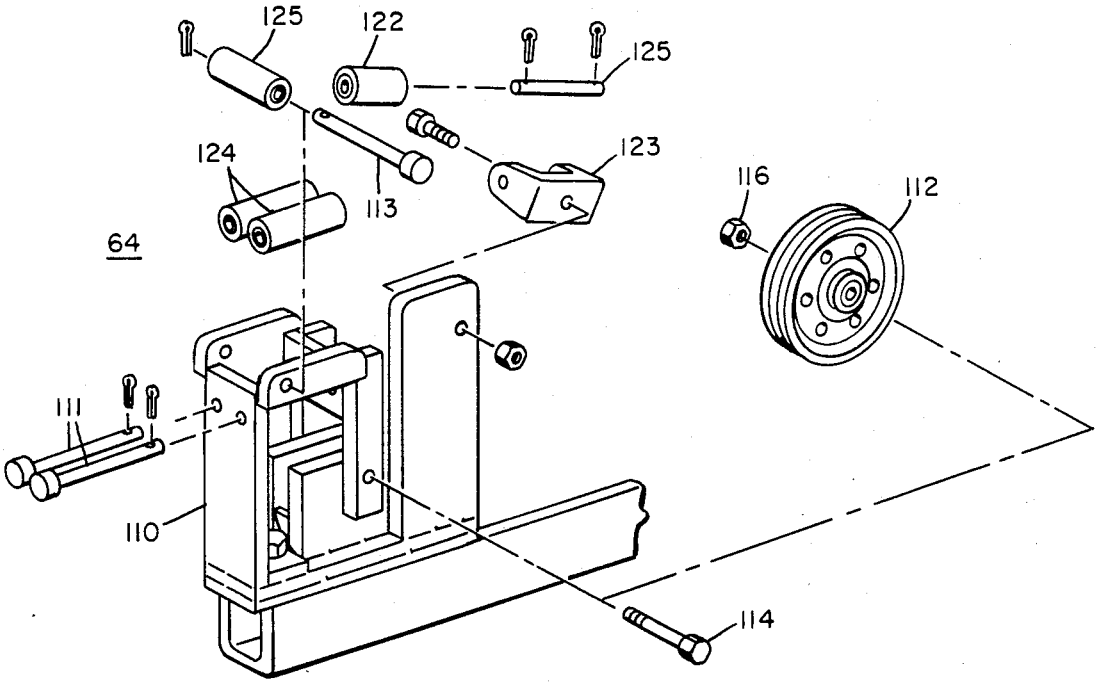
Fig. 8.

Fig. 12.
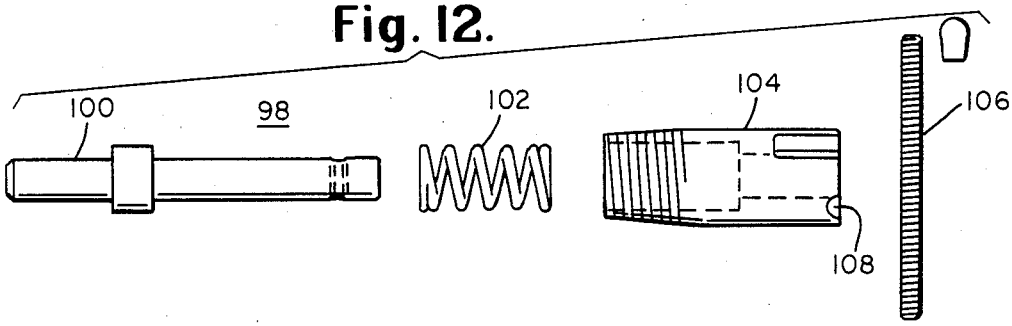
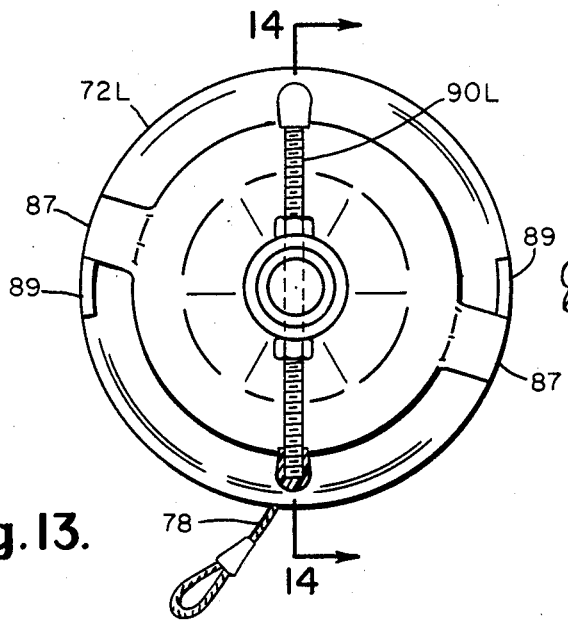
Fig. 13.
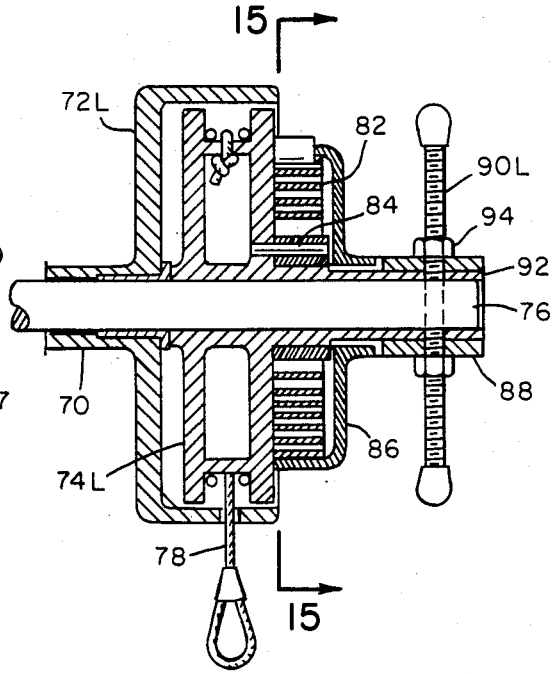
Fig. 14.
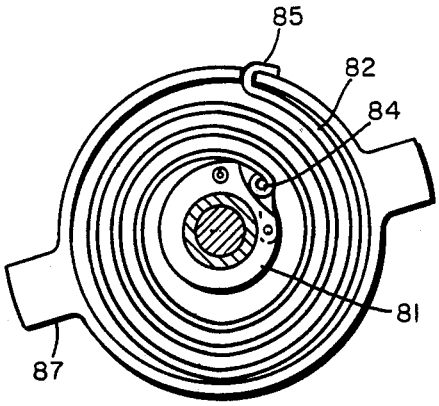
Fig. 15.

Fig. 16.
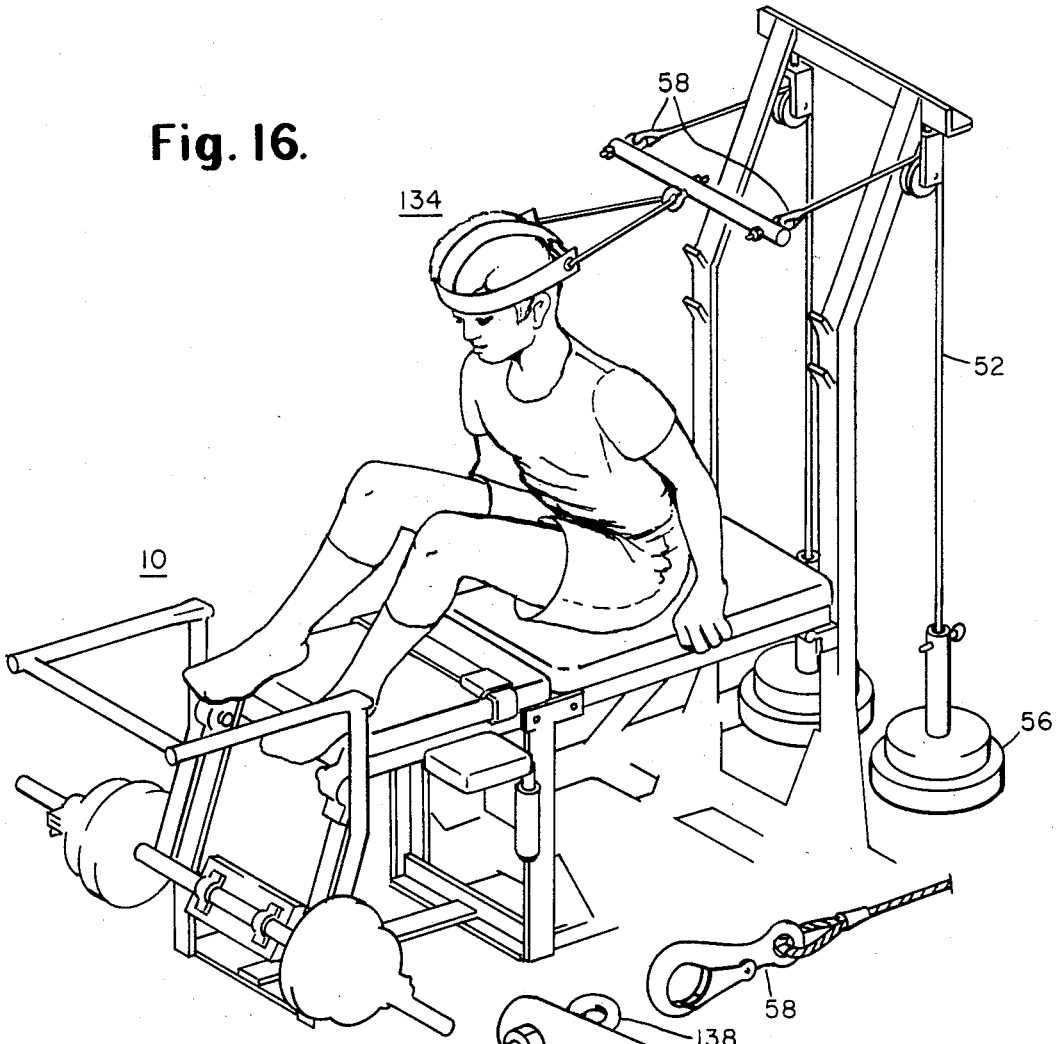
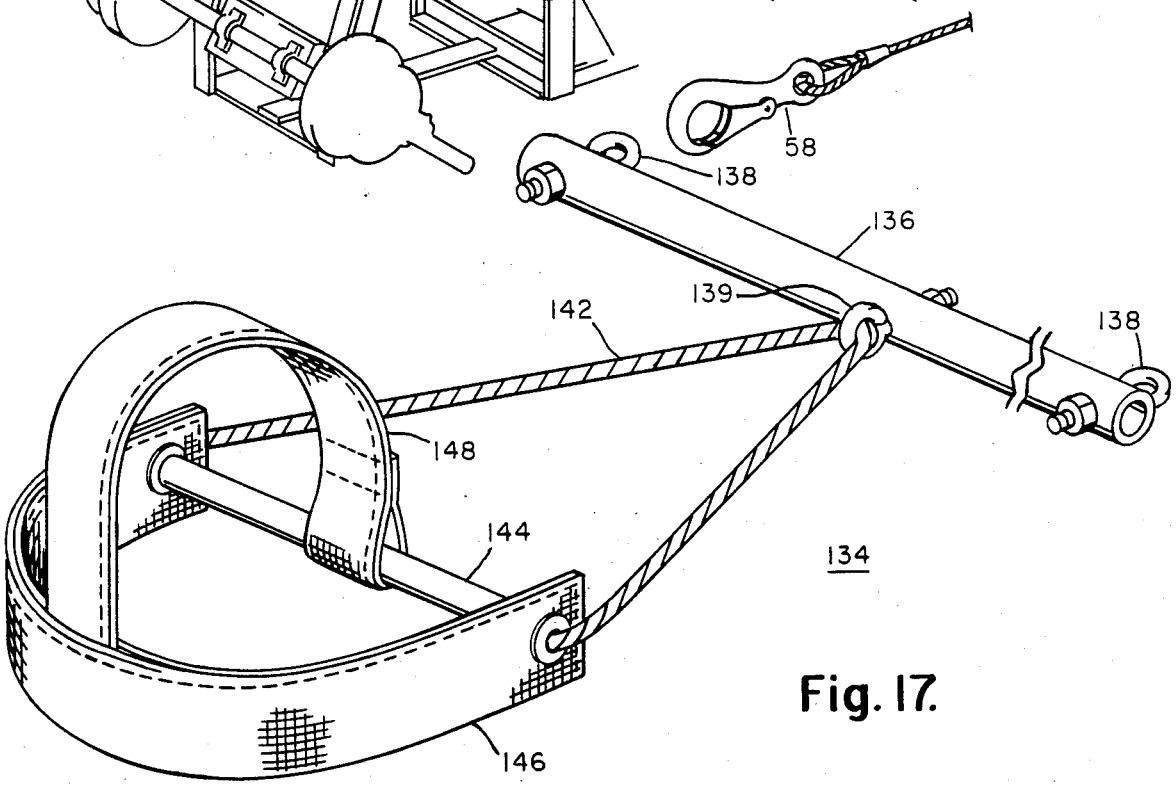
Fig. 17.

WEIGHT LIFTING GYM

PRIOR ART STATEMENT

The inventor knows of no uncited prior art anticipating this invention. The inventor is not withholding known prior art which he considers anticipates this invention.

This device relates to exercise devices, and particularly to a multi-purpose gym device utilizing a retractable pulley cable system whereby weights may be lifted from a variety of directions. Weight lifting exercises are utilized by many and have strength producing and healthful benefits. Such exercises are frequently engaged utilizing barbells, dumbbells and the like in which a heavy weight is rapidly lifted above the body. Such exercises tire the lifting muscles to the point where a barbell, dumbbell or the like may slip and fall from the exerciser's grasp injuring him. This can happen easily in such exercises as the prone press, the military press, clean and jerk, pull overs and the like. Persons have been seriously injured and even killed by a heavy weight slipping from the grasp and falling on the body of the weight lifter.

Weight lifters frequently wish to exercise their muscles by tensions coming from a variety of directions. This is done to insure the manipulations of numerous muscle groups and frequently requires stress to be applied in a direction other than vertical. This invention provides a cable handling system whereby stress may be applied to barbells or the like in a variety of directions selected by the weight lifter so that numerous muscle groups may be exercised in a variety of directions and positions. All of this may be accomplished within the confines of the present weight lifting gym invention.

The basic components of the present invention comprise:

1. A barbell with retractable cables utilizing a recoil spring and a hold/release lever which allows a weight attached cable to be connected with the barbell at a predetermined distance;

2. Pulley/roller assemblies adapted to guide a weight attached cable so that it may be utilized by a weight lifter from a variety of directions;

3. A fold-down backrest permitting standing, sitting, or lying exercises within the confines of the gym.

One of the primary advantages of this invention is the safety with which heavy weights may be lifted above the body without danger of them falling and causing injury. When using the barbell, the lifting weights rest on the floor in the lowered position of each exercise, thus the force of the weights is exerted on the barbell only at a predetermined safe distance from the weight lifter's body. The force the weights exert on the barbell is relieved permitting disengagement by a hold/release lever. Likewise hand held dumbbell type exercises can be performed with this gym eliminating dangerous weights held over the body. Thus the danger of accidentally dropping the weight and consequential injury is eliminated.

The gym device of this invention provides the user with a wider variety of conventional body building exercises using barbells, dumbbells and weight bench than any existing gym within its price range. Conventional weights for the barbell and dumbbell can be utilized in the gym. Furthermore, the gym is designed so that its functional parts may be easily replaced.

It is an object of this invention therefore to provide a weight lifting gym utilizing cable attached weights which eliminate the danger of a dropped weight falling upon and injuring the weight lifter.

It is another object of this invention to provide a gym device utilizing cables which allow weight stress to be applied from a variety of directions.

It is yet another object of this invention to provide a weight lifting gym which will permit numerous exercises to be performed.

It is yet another object of this invention to provide a gym with a fold-down backrest permitting standing, sitting, or lying exercises within the confines of the gym.

It is still another object of this invention to provide a cable attached barbell adapted to apply tension on the barbell in many pre-determined positions.

It is still another object of this invention to provide a low cost easily repairable gym device which will utilize conventional weight lifting weights.

It is still another object of this invention to provide a weight lifting gym which can be used with the neck developer set forth in this invention as well as the hand held exerciser.

These and other objects of the invention may be seen by reference to the attached Specification, Claims and drawings, in which:

FIG. 2, is a drawing taken along lines 2—2 of FIG. 1.

FIG. 3, is a drawing taken along lines 3—3 of FIG. 1.

FIG. 4, is a drawing taken along lines 4—4 of FIG. 3.

FIG. 5, is a drawing taken along lines 5—5 of FIG. 2.

FIG. 6, is a drawing of the pulley/roller assembly device taken along lines 6—6 of FIG. 1.

FIG. 7, is a side view of the pulley/roller assembly of FIG. 6.

FIG. 8, is an exploded third-dimensional view of the pulley/roller assembly of FIGS. 6 and 7.

FIG. 12, is a disassembled view of the end portion of the barbell device.

FIG. 13, is a view of the end portion of the barbell device taken along lines 13—13 of FIG. 9.

FIG. 14, is a cross-sectional view of the end portion of the barbell device taken along lines 14—14 of FIG. 13.

FIG. 15, is a view of the recoil spring device taken along lines 15—15 of FIG. 14.

FIG. 16, is a third-dimensional view of the invention with a neck exercising device attached.

FIG. 17, is a third-dimensional view of the neck exercising device of FIG. 16, shown in greater detail.

Figure 1:
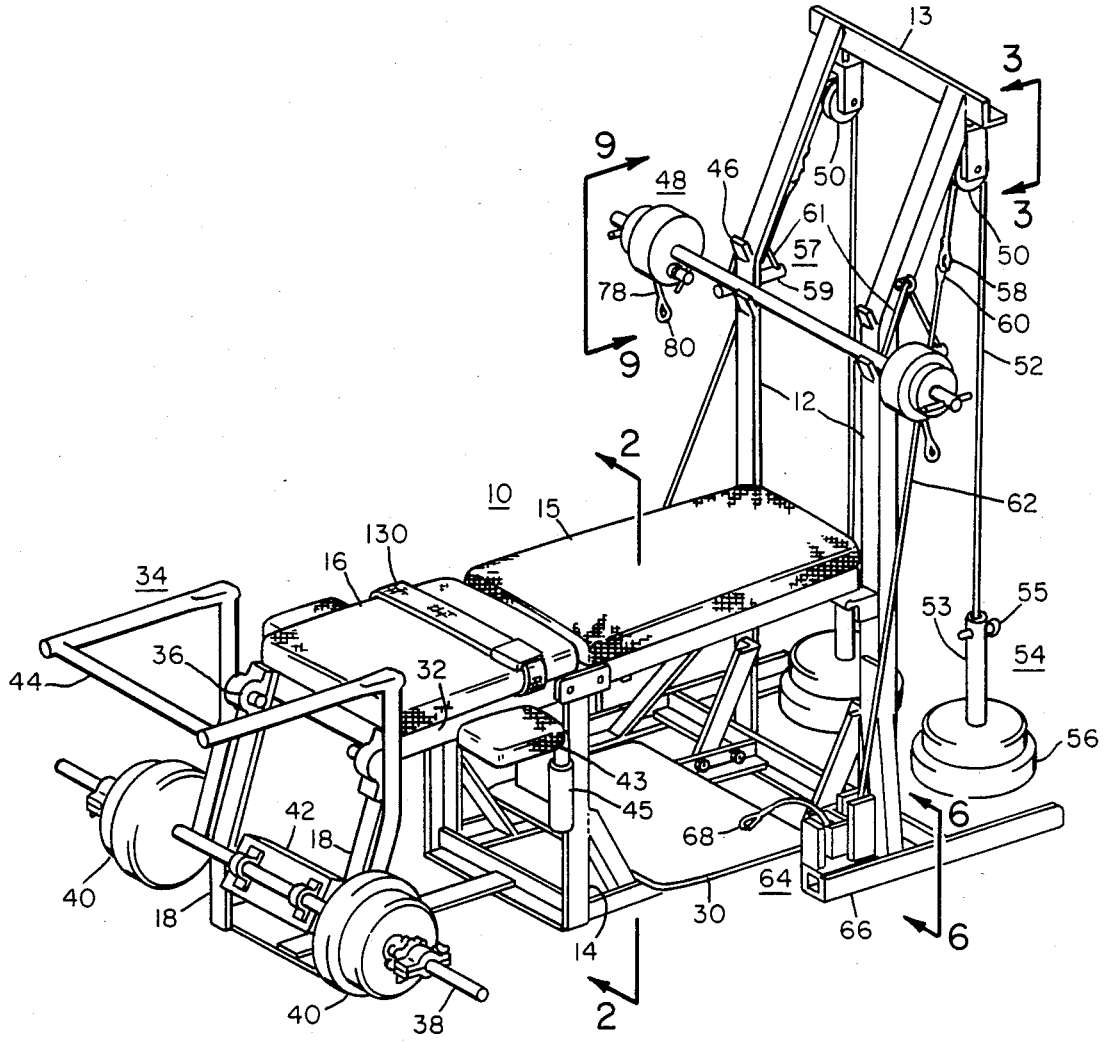
FIG. 1, is a third-dimensional drawing of the weight lifting gym device of this invention.
Figure 9:
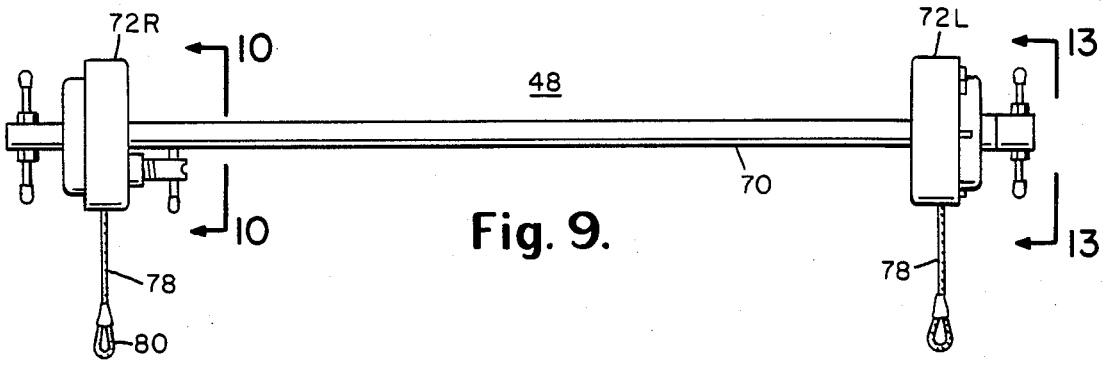
FIG. 9, is taken along lines 9—9 of FIG. 1 showing the side view of the barbell device.
Figure 10:
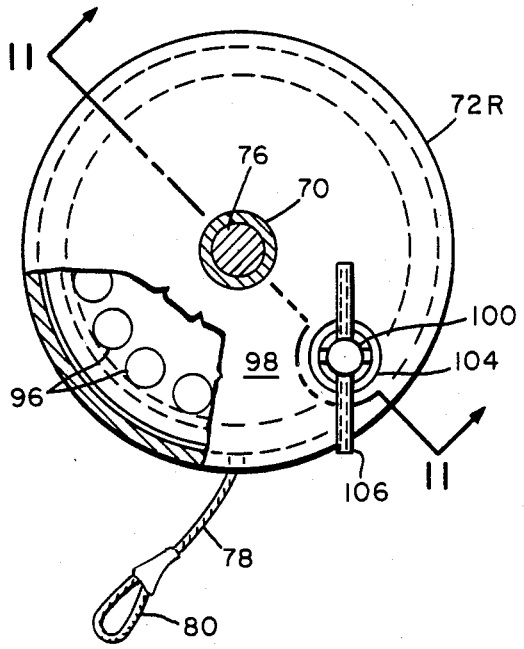
FIG. 10, is a view, partially in cross-section, taken along lines 10—10 of FIG. 9.
Figure 11:
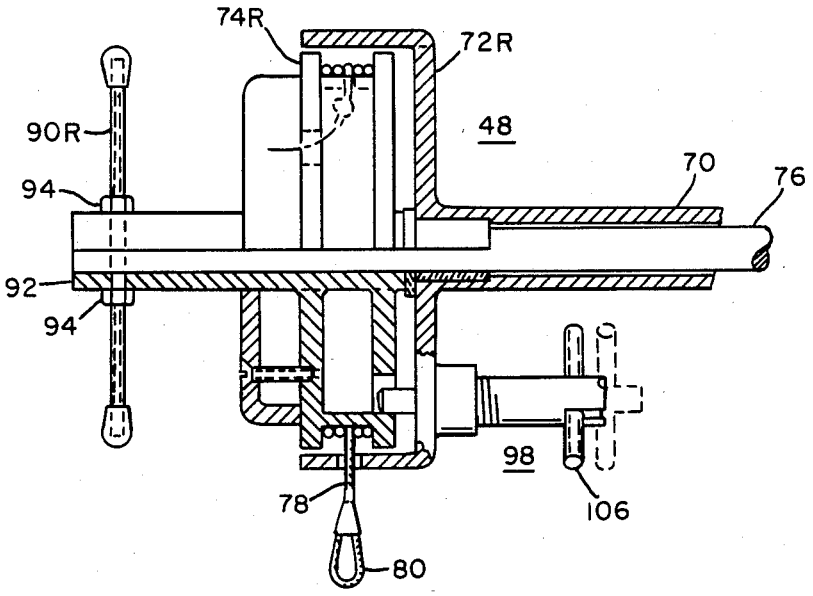
FIG. 11, is a cross-sectional view taken along lines 11—11 of FIG. 10 showing the end portion of the barbell device.

Referring to the drawings, and in particular to FIGS. 1 and 2, the weight lifting gym invention is comprised of a rectangular box frame 10 constructed of angle iron. Two vertically positioned pulley support legs 12 form two end portions thereof and extend upwardly where they are joined by horizontally positioned cross piece 13 integrally connected thereto. Two vertically positioned central legs 14 extend upwardly and support backrest 15 and leg lift seat 16. Upwardly disposed leg lift legs 18 support the opposite end portion of leg lift seat 16. Backrest 15 has a double hinge 19 attached to leg lift member 32 by hinge pins 20 which allow backrest 15 to pivot and lie upon leg rest seat 16. Hinge support 17 is attached to central legs 14. (See FIG. 2) Two backrest support members 22 having angular slots 24 therein are hinged on the opposite end portion of backrest 15. Angular slots 24 are adapted to engage horizontal member 26 which is integrally attached between pulley support legs 12. Backrest 15 may therefore be positioned in several different angles depending upon which angle slots 24 are engaged. Backrest support members 22 may be pivoted beneath backrest 15 and retained there by retainer 28 which locks the backrest support members 22 securely thereunder.

A floor plate 30 is integrally attached to the lower portion of box frame 10 directly under backrest 15 and serves as a foot platform for the weight lifter when the backrest 15 is pivoted out of the way. Leg lift seat 16 is supported by leg lift member 32 horizontally positioned between central legs 14 and leg lift legs 18. An L-shaped leg lift-rowing member 34 is pivotally attached to leg lift bearings 36 which are secured to leg lift legs 18. The lower portion of leg lift-rowing member 34 has a leg weight shaft 38 horizontally suspended forward of leg lift legs 18 and has two circular weights 40 on either side thereof. Weights 40 may be added to at will. A leg cushion 42 is attached to leg weight shaft 38 and adapted to cushion the weight lifter's legs when pressing against the leg weight shaft 38. A rowing bar 44 is positioned between leg lift-rowing members 34 and serves as a handle for the weight lifter to grasp while doing rowing exercises and sitting on leg lift seat 16.

Adjustable arm-curl supports 43 are pivoted on arm support hinges 45 which are vertically positioned upon central legs 14. The arm supports 43 may be pivoted outwardly to support the extended arms of the weight lifter while he is lying on the leg lift seat 16 and backrest 15. When not in use the adjustable arm supports 43 are pivoted inwardly and out of the way.

The upper portion of pulley support legs 12 has upwardly disposed barbell holders 46 positioned thereon and adapted to hold barbell 48 resting therebetween. Two upper pulleys 50 are attached to the end portion of cross piece 13. Weight cables 52 extend through upper pulleys 50 and are attached to weight retainers 54 on which are positioned pulley weights 56. Weight retainers 54 are comprised of a cylindrical tube 53 upon which conventional lifting weights 56 are placed. A retaining pin 55 extends through the upper portion of tube 53. The retaining pin 55 goes through a loop on the cable 52 securing it to the tube 53. The bottom portion of tube 53 has a base attached thereto (not shown) which supports the pulley weights 56. Pulley weights 56 may be added to or removed at will. The end portion of weight cables 52 has a snap 58 thereon which extends through a loop 60 on extension cable 62 which go through pulley/roller assemblies 64 attached to a ground extension 66 of box frame 10. Pulley/roller assemblies 64 are essentially a pulley through which extension cable 62 goes, redirecting its direction. The end portion of extension cable 62 has a lower snap hook 68 attached thereto. As may be seen, the pulling of lower snap hook 68 will raise pulley weights 56.

Two hand grips 57 are shown as hung on hook 132 which is secured to the upper portion of pulley support legs 12. They are hung on hook 132 when not in use. Hand grips 57 consist of a cylindrical hand holder 59 the end portions of which are attached to a hand cord 61 so as to form a loop. Lower snap hooks 68 are attached to the loop of the cords 61 when hand exercises are desired. Pulling of hand grips 57 will transmit tension through extension cable 62 and weight cable 52 to lift pulley weights 56.

Likewise hand grips 57 may be similarly attached directly to snaps 58 so as to lift pulley weights 56. The weight lifter may thus lie or sit on backrest 15, or stand on floor plate 30 while holding hand grips 57 in each hand and doing arm exercises. The direction of tension may be made to come from a variety of different directions so as to exercise particular muscle groups.

Referring now to FIGS. 9–15 inclusive, barbell 48 is comprised of a hollow barbell handle 70 integrally attached at either end to two cylindrically shaped pulley housings 72L and 72R which contain two barbell pulleys 74L and 74R. A barbell shaft 76 extends through barbell handle 70, pulley housing 72L and 72R, barbell pulleys 74L and 74R and outwardly therefrom. Each barbell pulley 74L and 74R has a barbell cable 78 wrapped therearound and extending outwardly therefrom at the end portion of which is a cable loop 80.

The left barbell pulley 74L has a helical recoil spring 82 adjacent and attached thereto and adapted to rewind barbell cables 78 after they have been pulled from barbell pulleys 74L and 74R. Helical recoil spring 82 is attached to the left barbell pulley 74L by means of pin 84 which extends through left barbell pulley 74L. A cylindrical spring cover 86 covers helical recoil spring 82. A collar 88 is positioned on shaft 76 adjacent to spring cover 86. Retaining screw 90L extends through collar 88, barbell pulley extension 92 and shaft 76 and is bolted thereon by nuts 94.

Barbell pulley 74R positioned on the opposite side of the barbell 48 contains on its inner side a series of circular holes 96 arranged in a circular pattern. A hold-release device 98 is positioned on the inner surface of pulley housing 72R and is adapted to press retaining pin 100 into a hole 96.

Referring to FIG. 12, a hold-release device 98 is comprised of a pin 100 having a central shoulder thereon, a pin spring 102 adapted to fit over pin 100 and be engaged by the pin shoulder. A casing 104 is positioned over both spring 102 and pin 100. A lever 106 passes through a hole in the end portion of pin 100. Recesses 108 in end portion of casing 104 hold lever 106 and pin 100 in an engaged and disengaged position whereby pin 100 extends through a hold 96 or is held outwardly therefrom. When pin 100 is in the inward or engaged position and extending through a hole 96, barbell pulley 74R is locked to pulley housing 72R. When hold-release device 98 is in the disengaged position, barbell pulley 74R is free to turn. A retaining screw 90R with lock nuts 94 extend through barbell pulley extension 92 and shaft 76.

In operation, when hold-release device 98 is in its disengaged position, barbell cables 78 may be pulled outwardly against the tension of recoil spring 82. When hold-release device 98 is in its engaged position, barbell cables 78 are locked and may be used to lift the pulley weights 56.

Referring to FIGS. 6, 7 and 8, the pulley/roller assembly 64 is comprised of a supporting frame 110 having a rotating pulley 112 thereon. A pivot bolt 114 extends through the frame 110 and the pulley 112 rotates about it. A pivot nut 116 engages threads upon pivot bolt 114 securing it to frame 110. A cable guide 118 is attached to frame 110 adjacent to the bottom portion of pulley 112 and guides cable 62 therethrough. A laterally positioned guide roller 122 is attached to frame 110 and guides the incoming cable 62 therethrough.

Roller guide 122 has a pin 125 therethrough which extends through a U-shaped guide support 123, bolted to supporting frame 110. Cable 62 extends around pulley 112 in an upward direction and through two lateral guide rollers 124 and a front roller 125 which are rotatably attached to supporting frame 110. Lateral guide rollers 124 are rotatably pinned to supporting frame 110 by lateral pins 111 extending therethrough. Front roller 125 is likewise rotatably secured to supporting frame 110 by front pin 113 which extends through both front roller 125 and through holes in supporting frame 110. As may be seen all rollers and pulley on the pulley/-roller assembly 64 may be easily replaced by easy removal of their supporting pins or bolt. The assembly is thus inexpensive and easy to maintain and repair. Thus exiting cable 62 may be extended in many directions so as to be in contact with lateral guide rollers 124 and front roller 125. The end portion of cable 62 has a lower snap hook 68 for attachment to the barbell 48, to hand exercise devices or to the leg lift member 38.

The operation of barbell 48 is as follows. Barbell cables 78 are attached to lower snap hook 68, thus putting the barbell 48 in cable communication with pulley weights 56. The weight lifter may then lie upon backrest 15 in preparation for the prone press exercises. Hold-release device 98 is placed in the release position withdrawing pin 100 from a circular hole 96. The barbell is then positioned above the weight lifter's chest but not in contact with his body. In the positioning of the barbell, barbell cables 78 are withdrawn, rotating pulleys 72L and 72R against the tension of helical recoil spring 82. In this rotation pulley 72L rotates, causing recoil spring 82 to rotate through pin 84. The other end portion of recoil spring 82, attached to spring cover 86, is held rigid because lugs 87 bear against the protrusions 89 from the pulley housing 72L. As pulley 72R unwinds, rotation is imparted to shaft 76 through retaining screw 90R.

When the barbell 48 is positioned at the right height, a hold-release device 98 is turned causing pin 100 to be inserted into a hole 96, thus locking the barbell 48. When the barbell 48 is raised, pulley weights 56 are lifted through weight cables 52 and extension cable 62. The pulley weights 56 only bear against the barbell until the barbell is positioned at the point where hold-release device 98 is engaged. Hence, if barbell 48 is accidentally dropped while fully extended, the full force of pulley weights 56 will not strike the weight lifter's body, hence he will not be injured. When the exercise is completed, the weight lifter merely releases hold-release device 98, pulling pin 100 from the hole 96. The cable tension from weights 56 is thus completely released. The cable 78 will then be withdrawn about pulleys 74L and 74R by helical recoil spring 82.

It should be noted that helical recoil spring 82 applies tension for the release or withdrawal of cables 78 through both pulleys 74L and 74R. When barbell cables 78 are pulled outwardly, barbell pulley 74L rotates against the tension of helical recoil spring 82. Pulley 74L rotates shaft 76 through retaining screw 90L. Shaft 76 then rotates pulley 74R through retaining screw 90R. When hold-release device 98 is released and pin 100 inserted in a hole 96, both barbell pulleys 74L and 74R are locked and will not rotate further. Thus when barbell 48 is lifted, cable 78 lifts pulley weights 56 through the cable system.

A neck exercising device 134 may be used in conjunction with the gym. The neck exercising device 134 is comprised of a head harness and attaching mechanism, and may be coupled to the invention by snaps 58 or lower snap hooks 68. This neck exercising device 134 consists of a hollow cylindrical neck bar 136, the end portions of which are attached to eye bolts 138 to which snaps 58 or lower snap hooks 68 may be connected. An eye bolt 139 is bolted through the central portion of neck bar 136 in the direction opposite to eye bolts 138.

The head harness is comprised of a transverse band 146 made of cloth, flexible plastic, or the like which passes around the side and forehead portion of the exerciser's head. A looped cord 142 extends through the end portions of transverse band 146, a rigid separator tube 144 and through eye bolt 139. Top band 148 is sewn to the central portion of transverse band 146, extends upwardly over the top of the head and is looped and sewn about separator tube 144. When the neck exercising device is placed over the head and attached to the invention, movements of the head will cause pulley weights 56 to rise. The neck exerciser may be used while the weight lifter is sitting on backrest 15 (FIG. 16) or may be used when the weight lifter is sitting or standing in other positions. Attachment of the neck bar 136 to lower snap hooks 68 allows a downward force to be applied to the head harness permitting the neck to be exercised at numerous angles.

In operation, the weight lifting gym device may be used to perform a number of exercises. Lower snap hook 68 may be attached to cable loops 80 of the barbell 48. The weight lifter then may lie down on backrest 15 with his head directly under the barbell and do prone presses. Likewise backrest 15 may be rotated on hinge pins 20 resting on leg lift seat 16. The weight lifter then may stand on floor plate 30 and do standing presses, arm curls and the like with barbell 48. The weight lifter may also lie on backrest 15 with hand handles (not shown) attached to lower snap hooks 68 and do outstretched arm exercises. A belt 130 is attached to leg lift seat 16 and may be buckled about the weight lifter's body to secure his position during particular exercises.

I claim:

1. A weight lifting gym, comprising in combination:

a bench a hinged backrest pivotally attached to said bench;

a cable, pulley connected to said bench and attached to lifting weights;

a pulley/roller device adapted to guide said cable, said pulley/roller device being attached to said bench;

a barbell positioned upon said bench and attached to said cable, said barbell is comprised of, in combination:

a hollow handle having pulley housings at each end portion thereof;

a solid shaft within said hollow handle;

two cable pulleys rotatably positioned at the end portions of said hollow handle, one of said pulleys having a plurality of holes therethrough;

two cables, each wrapped around one of said pulleys and extending outwardly therefrom;

a pulley spring attached to one of said pulleys in winding relationship with said cable;

a hold-release device attached to one of said pulley housings connecting said pulley housing to said pulley;

means for integrally attaching said hollow handle to said shaft;

a leg lift-rowing device pivotally attached to said bench.

2. The combination as claimed in claim 1, in which said pulley/roller device is comprised of, in combination:

a housing;

a pulley pivotally attached to said housing and having a cable extend therearound;

two lateral guide rollers rotatably attached to said housing in guiding contact with said cable;

a front roller rotatably attached to said housing in guiding contact with said cable;

a rear roller device rotatably attached to said housing in guiding contact with said cable.

3. The combination as claimed in claim 2, in which the cable from said pulley/roller device is attached to the cable from said barbell.

4. The combination as claimed in claim 3, having adjustable armrests attached to said bench.

5. The combination as claimed in claim 4, in which said hold-release device is comprised of, in combination:

a pulley housing having a plurality of holes therethrough;

a spring loaded plunger extendable within one of said plurality of holes.

6. The combination as claimed in claim 5, in which said pulley spring is rotatably positioned about said hollow handle;

a spring lock attached to said pulley housing in locking relationship with said pulley spring.

7. The combination as claimed in claim 6, in which said leg lift-rowing device has adjustable weights attached thereto.

8. A weight lifting gym, comprising in combination:

a bench;

a hinged backrest pivotally attached to said bench;

a cable, pulley connected to said bench and attached to lifting weights;

a neck exercising device attached to said cable, said neck exercising device comprising of, in combination:

a transverse band adapted to extend around the forehead;

a rigid separator tube connected to the end portions of the transverse band;

a top band connected between said separator tube and said transverse band;

a cord loop passing through said transverse band and said separator tube;

a neck bar attached to said cord loop and said cable;

whereby movement of said neck exercising device will raise said lifting weights;

a pulley/roller device adapted to guide said cable, said pulley/roller device being attached to said bench;

a barbell positioned upon said bench and attached to said cable;

a leg lift-rowing device pivotally attached to said bench.

9. A weight lifting gym, comprising in combination:

a bench;

a hinged backrest pivotally attached to said bench;

a cable, pulley connected to said bench and attached to lifting weights;

a pulley/roller device comprised of, in combination:

a housing;

a pulley pivotally attached to said housing and having a cable extend therearound;

two lateral guide rollers rotatably attached to said housing in guiding contact with said cable;

a front roller rotatably attached to said housing in guiding contact with said cable;

a rear roller device rotatably attached to said housing in guiding contact with said cable;

a barbell positioned upon said bench and attached to said cable;

a leg lift-rowing device pivotally attached to said bench.

* * * * *